US007300334B2

(12) United States Patent
Liu

(10) Patent No.: US 7,300,334 B2
(45) Date of Patent: Nov. 27, 2007

(54) DRILLING-HEAD-GRINDING POSITIONING DEVICE

(76) Inventor: Mao-Sung Liu, 235 Chung-Ho Box 8-24, Taipei (TW)

( * ) Notice: Subject to any disclaimer, the term of this patent is extended or adjusted under 35 U.S.C. 154(b) by 56 days.

(21) Appl. No.: 11/394,247

(22) Filed: Mar. 31, 2006

(65) Prior Publication Data

US 2007/0232208 A1 Oct. 4, 2007

(51) Int. Cl.
*B24B 49/00* (2006.01)

(52) U.S. Cl. ..... 451/11; 451/48; 451/375

(58) Field of Classification Search ..... 451/11, 451/12, 14, 15, 48, 374, 375, 376
See application file for complete search history.

(56) References Cited

U.S. PATENT DOCUMENTS 3,656,264 A * 4/1972 Mackey et al. ..... 451/48
3,808,748 A * 5/1974 Gunnerson ..... 451/375
3,820,286 A * 6/1974 Burch ..... 451/227
4,485,596 A * 12/1984 Bernard et al. ..... 451/375
5,649,853 A * 7/1997 Kuo ..... 451/178
6,283,830 B1 * 9/2001 Kuo ..... 451/11

* cited by examiner

*Primary Examiner*—Dung Van Nguyen

(57) ABSTRACT

A drilling-head-grinding positioning device comprises a clamper for clamping a drilling head having a rectangular sliding rod and a sleeve clamping seat installed at a front end of the sliding rod, a cylindrical clamping device received in the sleeve clamping seat and a nut screwed at a front end of the sleeve clamping seat; and an adjustable seat; and a top of the adjustable seat having a V shape sliding recess corresponding to the periphery of the sliding rod; a bottom of the sliding recess being formed with a receiving trench for receiving a threaded rod; one side of the sliding recess being formed with a communicating groove communicated to the receiving trench; a hook rod being slidably installed in the receiving trench; and a front end of the hook rod being extended upwards with a plate corresponding to a front end of the sliding rod.

4 Claims, 6 Drawing Sheets

DRILLING-HEAD-GRINDING POSITIONING DEVICE

FIELD OF THE INVENTION

The present invention relates to drillers, and in particular to a drilling-head-grinding positioning device, wherein the protrusion length of the drilling head is adjustable.

BACKGROUND OF THE INVENTION

In the prior art driller, the drilling head is installed at a clamper and then the clamper is installed to a grinding seat. A grinding wheel serves to grind the drilling head. The clamper is rotatable so that the front end of the drilling head is grounded to have a sharp surface.

However in the prior art the clamper cannot move along the grinding seat so that the length of the drilling head along the grinding seat must be calibrated by a calibration device. Thereby the calibration work is performed repeatedly. The operation is inconvenient and time consumed.

SUMMARY OF THE INVENTION

Accordingly, the primary object of the present invention is to provide a drilling-head-grinding positioning device, wherein the protrusion length of the drilling head is adjustable. To achieve above objects, the present invention provides a drilling-head-grinding positioning device which comprising: a clamper for clamping a drilling head having a rectangular sliding rod and a sleeve clamping seat installed at a front end of the sliding rod, a cylindrical clamping device received in the sleeve clamping seat and a nut screwed at a front end of the sleeve clamping seat; and an adjustable seat; and a top of the adjustable seat having a V shape sliding recess corresponding to the periphery of the sliding rod; a bottom of the sliding recess being formed with a receiving trench for receiving a threaded rod; one side of the sliding recess being formed with a communicating groove communicated to the receiving trench; a hook rod being slidably installed in the receiving trench; a front end of the hook rod being extended upwards with a plate corresponding to a front end of the sliding rod; a rear axial center of the hook rod being formed with a threaded hole; a press having one end fixed to the communicating groove by using a screw rod; another end of the press being retained above the hook rod to position the hook rod; a top of the press being lower than the plate; the hook rod adjusting button being a round button and being rotatably combined to the screw rod; and the screw rod being installed in the threaded hole at the rear end of the hook rod; an adjustable seat having a base, a rotary seat which is rotatably combined to one side of the base, an assembly arm combined to the rotary seat, a hook rod adjusting set combined to the assembly arm and the rotary seat; the base having a bottom plate; one side of the bottom plate being extended with a rotatable combining portion; the rotary seat being a long block; one side thereof having a pivoted portion corresponding to the combining portion; thereby the rotary seat being rotatably combined to the base; a top of the rotary seat having the V shape sliding recess corresponding to the periphery of the sliding rod; the assembly arm being an L shape arm; one end of the assembly arm being combined to a rear surface of the rotary seat and another end thereof being aligned to an opening of the sliding trench; the hook rod adjusting set including a hook rod, a hook rod adjusting button and a threaded rod; the hook rod being a rectangular rod and being slidably installed in the receiving trench; a front end of the hook rod being extended upwards with a plate corresponding to a front end of the sliding rod; a rear axial center of the hook rod being formed with a threaded hole; a press having one end fixed to the communicating groove by using a screw rod; another end of the press being retained above the hook rod to position the hook rod; a top of the press being lower than the plate; the hook rod adjusting button being a round button and being rotatably combined to the screw rod; the screw rod being installed in the threaded hole at the rear end of the hook rod.

A periphery of the hook rod adjusting button has scales, and the assembly arm is formed with a base scale corresponding to the scale of the adjusting button.

Four corners of the sliding rod are chamfered to form chamfered surfaces; the sliding rod is formed with an axial through hole. One front side of the sliding rod near the sleeve clamping seat is formed with an annular recess; the sliding rod has a threaded hole at the front end of the sliding rod. The threaded hole is communicated to the through hole;

The sleeve clamping seat is a round tube and a receiving tube extends from the sleeve clamping seat. The receiving tube is received in the through hole of the sliding rod. A periphery of the receiving tube has an annular recess; a screw screws into the threaded hole. An inner end of the screw resists against the annular recess so as to position the sleeve clamping seat to the sliding rod. An axial center of the sleeve clamping seat is formed with a tapered hole having a larger front end. A front end of the tapered hole is expanded as a threaded portion.

A periphery of the rear end of the cylindrical clamping device is a tapered surface and a front end thereof is formed with a clamping body, and a rear end thereof is corresponding to the tapered hole of the sleeve clamping seat. The drill head hole is formed at a front end of the clamping device.

A periphery of a rear end of the nut is formed with a threaded portion which is different to the threaded portion at the front end of the sleeve clamping seat; a front end of the nut has an embedding tapered hole corresponding to the shape of front end of the clamping device and engaging thereto.

The various objects and advantages of the present invention will be more readily understood from the following detailed description when read in conjunction with the appended drawing.

DETAILED DESCRIPTION OF THE INVENTION

Figure 1:
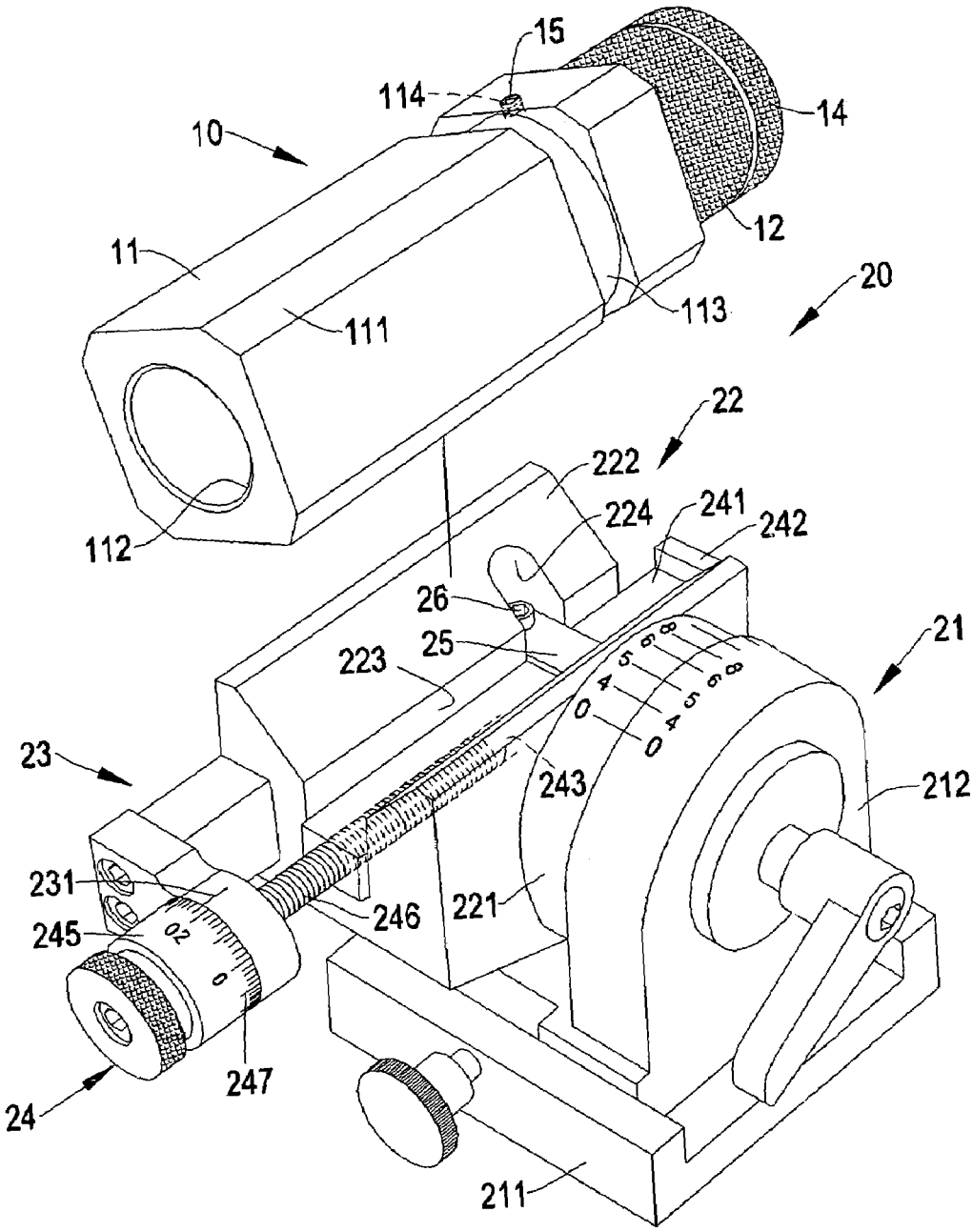
FIG. 1 is an exploded perspective view of the preferred embodiment of the present invention.
Figure 2:
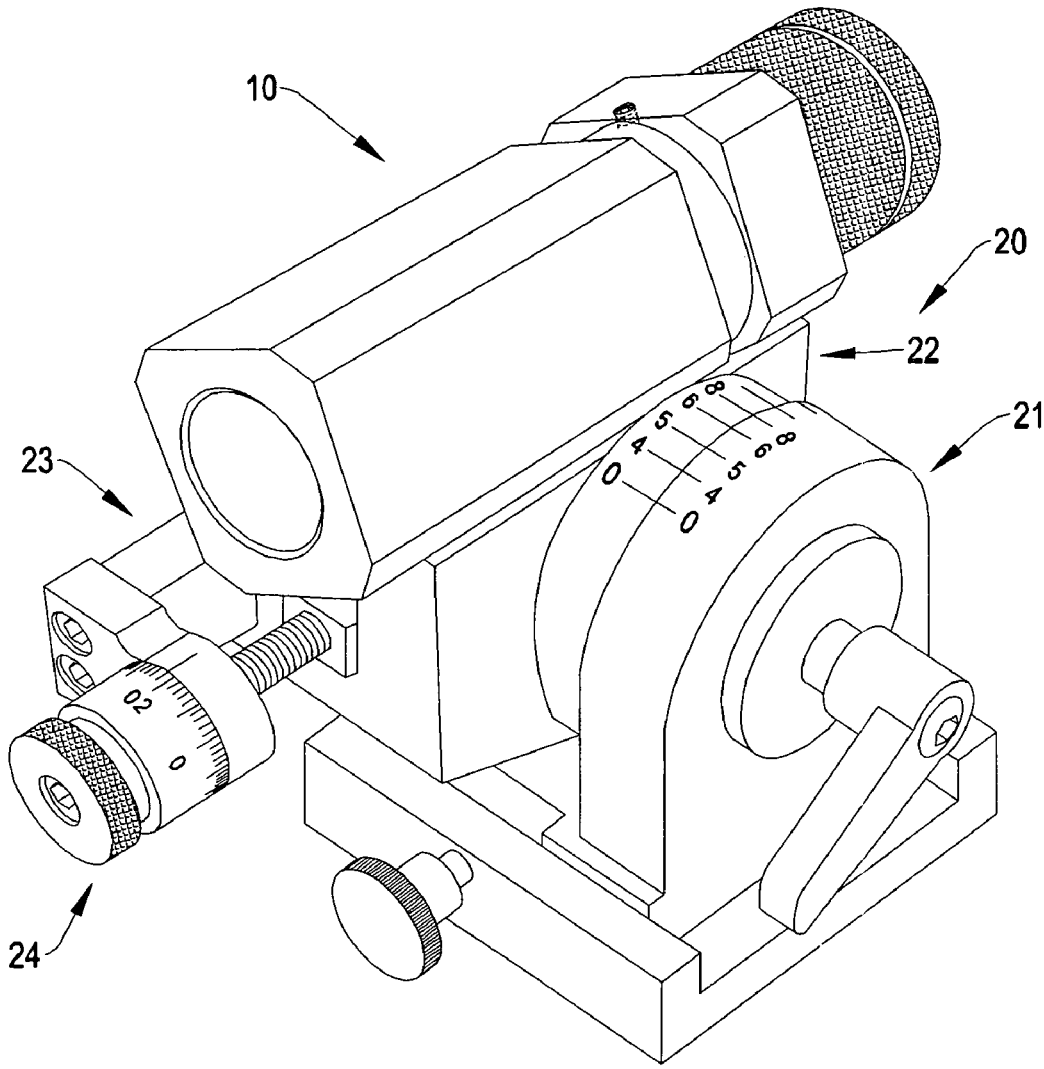
FIG. 2 is an assembled perspective view of the preferred embodiment of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 5, the drilling-head-grinding positioning device of the present invention is illustrated. The present invention has the following elements.

A clamper 10 for clamping a drilling head has a rectangular sliding rod 11 and a sleeve clamping seat 12 installed at a front end of the sliding rod 11, a cylindrical clamping device 13 received in the sleeve clamping seat 12 and a nut 14 screwed at a front end of the sleeve clamping seat 12.

Four corners of the sliding rod 11 are chamfered to form chamfered surfaces 1111. The sliding rod 11 is formed with an axial through hole 112. One front side of the sliding rod 11 near the sleeve clamping seat 12 is formed with an annular recess 113. The sliding rod 11 has a threaded hole 114 at the front end of the sliding rod 11. The threaded hole 114 is communicated to the through hole 112.

The sleeve clamping seat 12 is a round tube and a receiving tube 121 extending from the sleeve clamping seat 12. The receiving tube 121 is received in the through hole 112 of the sliding rod 11. A periphery of the receiving tube 121 has an annular recess 122. A screw 15 screws into the threaded hole 114. An inner end of the screw 15 resists against the annular recess 122 so as to position the sleeve clamping seat 12 to the sliding rod 11. An axial center of the sleeve clamping seat 12 is formed with a tapered hole 123 with a larger front end. A front end of the tapered hole 123 is expanded as a threaded portion 124.

A periphery of the rear end of the cylindrical clamping device 13 is a tapered surface and a front end thereof is formed with a clamping body, and a rear end thereof is corresponding to the tapered hole 123 of the sleeve clamping seat 12. The drill head hole 131 is formed at a front end of the clamping device 13.

A periphery of a rear end of the nut 14 is formed with a threaded portion 141 which is different to the threaded portion 141 at the front end of the sleeve clamping seat 12. A front end of the nut 14 has an embedding tapered hole 142 corresponding to the shape of front end of the clamping device 13 and engaging thereto.

An adjustable seat 20 has a base 21, a rotary seat 22 which is rotatably combined to one side of the base 21, an assembly arm 23 combined to the rotary seat 22, a hook rod adjusting set 24 combined to the assembly arm 23 and the rotary seat 22.

The base 21 has a bottom plate 211. One side of the bottom plate 211 is extended with a rotatable combining portion 212.

The rotary seat 22 is a long block. One side thereof has a pivoted portion 221 corresponding to the combining portion 212. Thereby the rotary seat 22 is rotatably combined to the base 21. A top of the rotary seat 22 has a V shape sliding recess 222 corresponding to the periphery of the sliding rod 11. A bottom of the sliding recess 222 is formed with a rectangular receiving trench 223 for receiving a threaded rod. One side of the sliding recess 222 is formed with a communicating groove 224 communicated to the receiving trench 223.

The assembly arm 23 is an L shape arm. One end of the assembly arm 23 is combined to a rear surface of the rotary seat 22 and another end thereof is aligned to an opening of the sliding trench 223.

The hook rod adjusting set 24 includes a hook rod 241, a hook rod adjusting button 245 and a threaded rod 246. The hook rod 241 is a rectangular rod and is slidably installed in the receiving trench 223. A front end of the hook rod is extended upwards with a plate 242. corresponding to a front end of the sliding rod 11. A rear axial center of the hook rod 241 is formed with a threaded hole 243. A press 25 has one end fixed to the communicating groove 224 by using a screw rod 26. Another end of the press 25 is retained above the hook rod 241 to position the hook rod 241. A top of the press 25 is lower than the plate 242. The hook rod adjusting button 245 is a round button and is rotatably combined to the screw rod 246. The screw rod 246 is installed in the threaded hole 243 at the rear end of the hook rod 241. A periphery of the hook rod adjusting button 245 has scales 247. Furthermore, the assembly arm 23 is formed with a base scale 231 corresponding to the scale 247 of the adjusting button 245.

Figure 3:
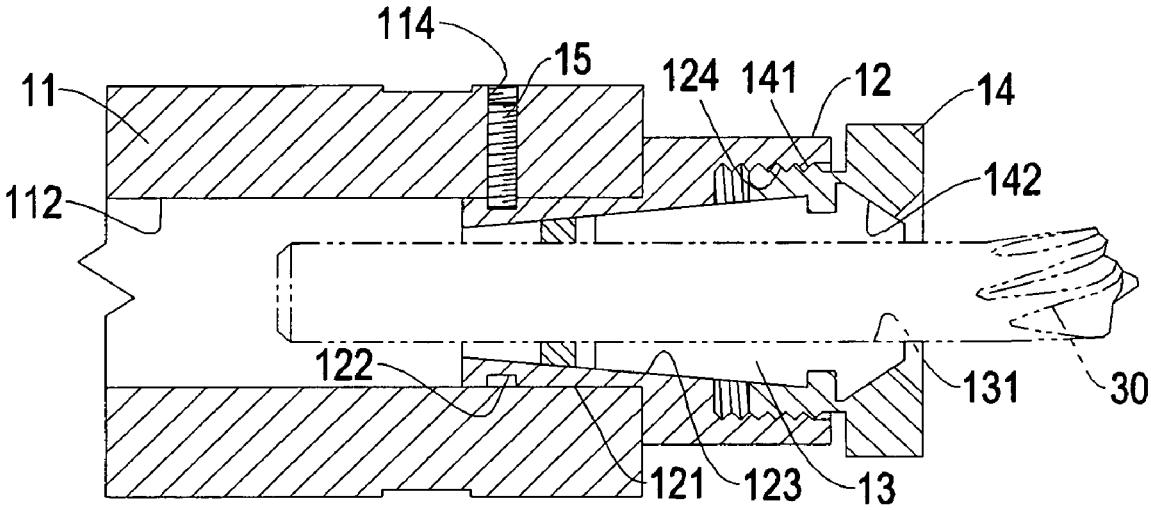
FIG. 3 is a cross sectional view of the clamper in the preferred embodiment of the present invention.
Figure 4:
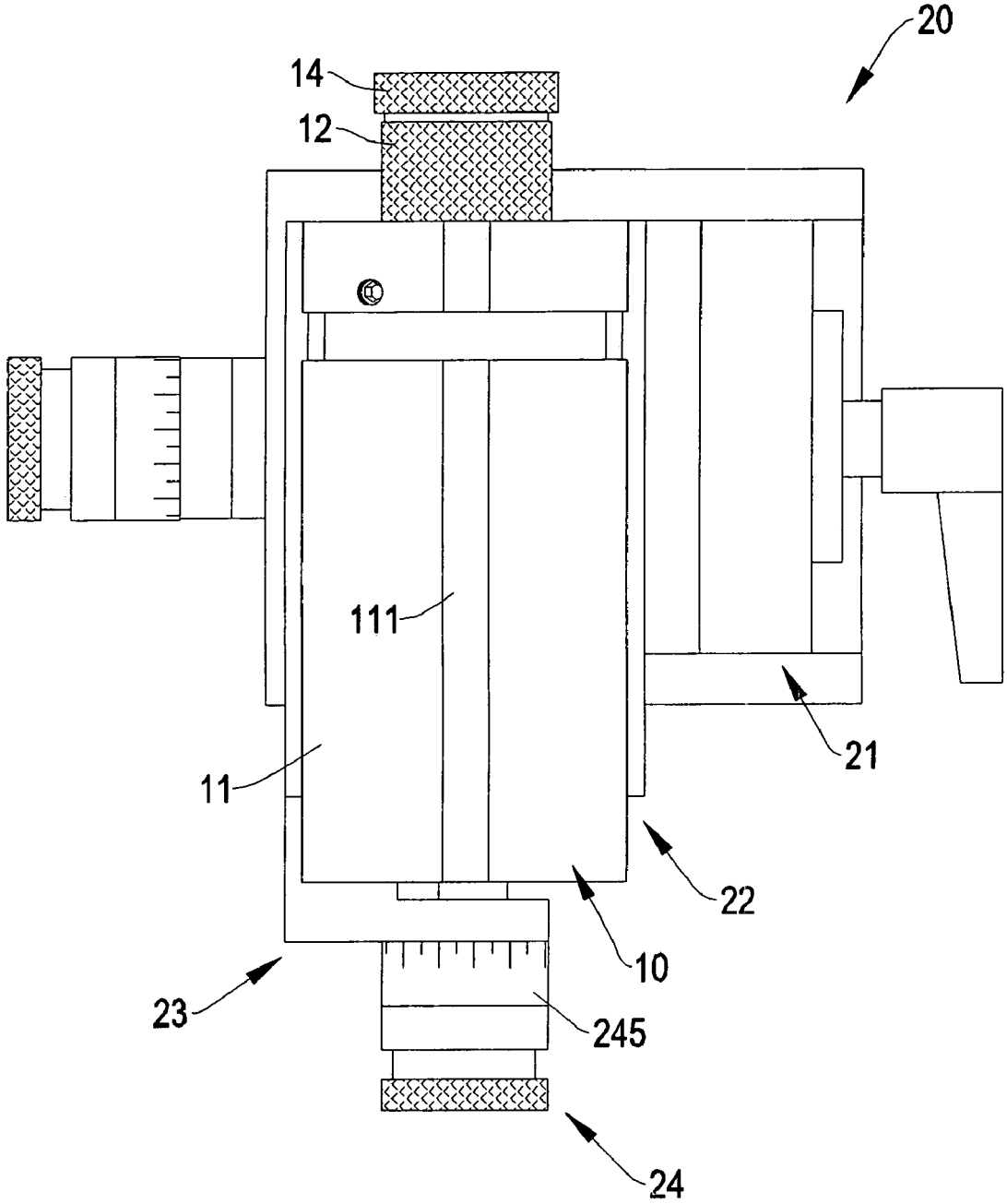
FIG. 4 is an upper view of the preferred embodiment of the present invention.
Figure 5:
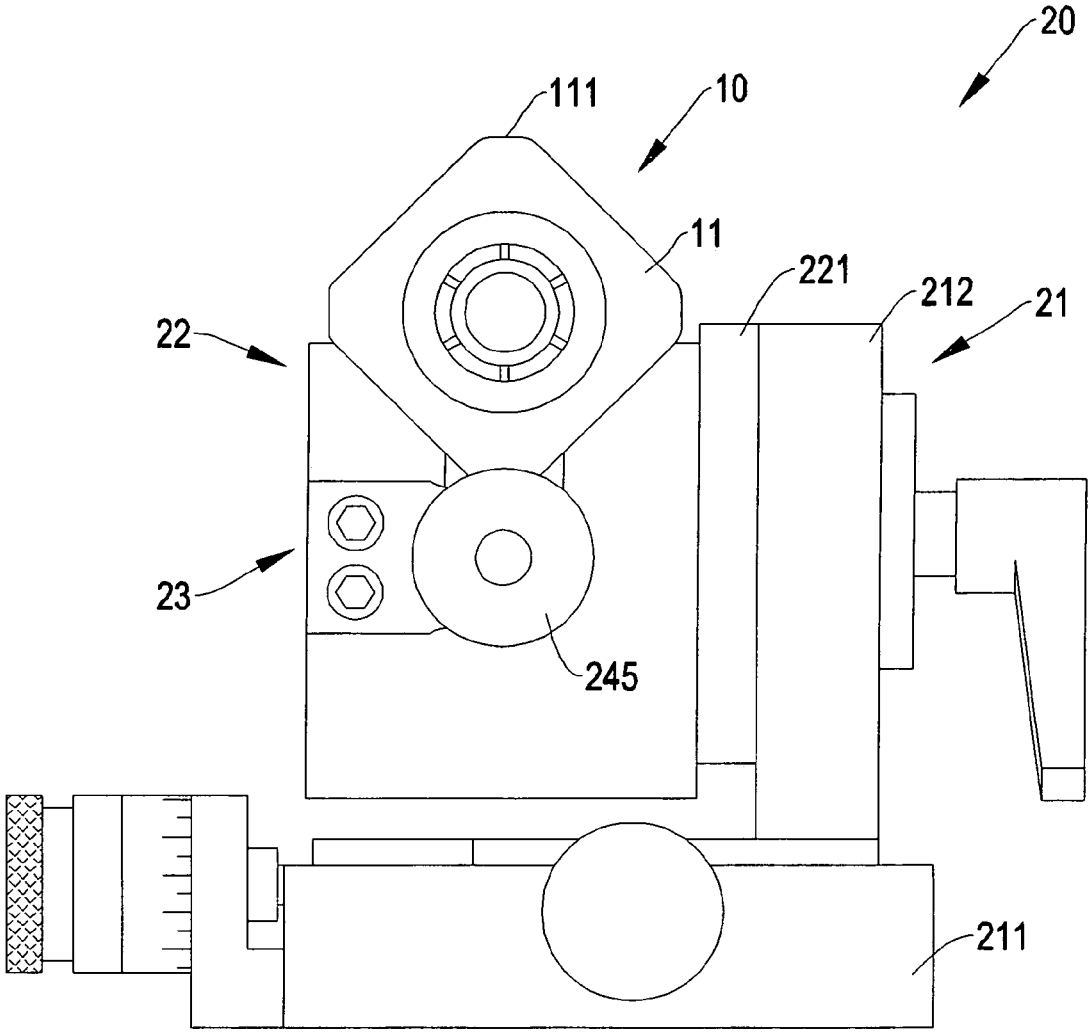
FIG. 5 is a rear view of the preferred embodiment of the present invention.
Figure 6:
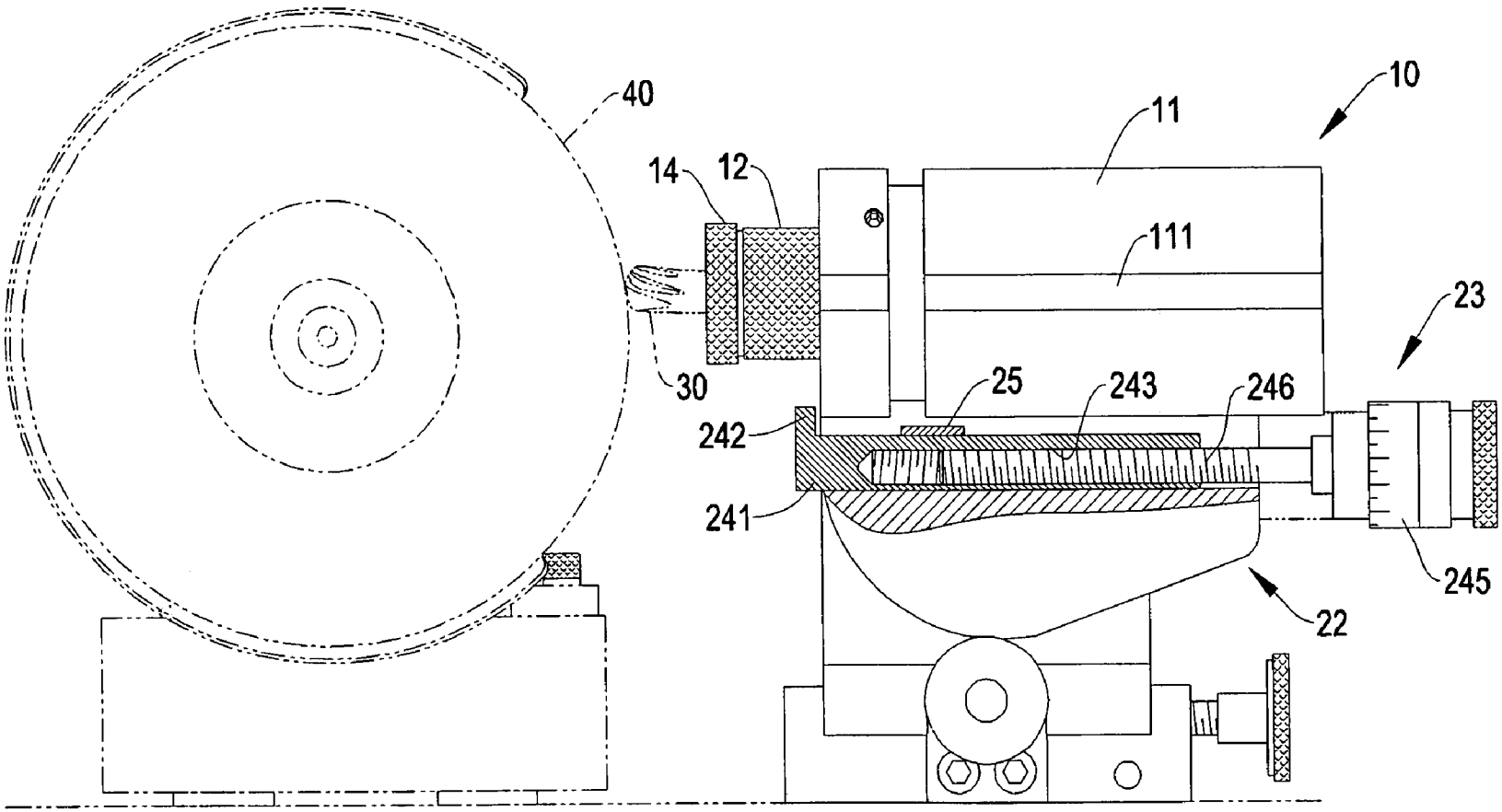
FIG. 6 is a schematic view about the preferred embodiment of the present invention.

With reference to FIGS. 1, 3 and 6, in the present invention, the drilling head 30 is inserted into the drilling head hole 131 of the clamping device 13. The nut 14 is screwed into the sleeve clamping seat 12. Thus, the clamping device 13 will clamp the drilling head 30. Then two surfaces of the sliding rod 11 will position on the adjustable seat 20. Then, the plate 242 at the front end of the hook rod 241 resists against the front end of the sliding rod 11 of the clamper 10. Thereby the length of the drilling head 30 protruded from the clamper 10 is adjusted. The rotary seat 22 is rotatable along the combining portion 212 of the base 21 for adjusting the orientation of the drilling head 30 so that the drilling head 30 can be used to grind a sharp surface.

In the present invention, when it is desired to adjust the protruding length of the drilling head 30, the hook rod adjusting button 245 is rotated to drive the threaded rod 245 to rotate so as to adjust the plate 242 at the front end of the hook rod 241 to slide forwards and backwards. By the matching of the scale 247 and the base scale 231, the moving length of the hook rod 241 can be adjusted precisely. When the clamper 10 is positioned in the V shape sliding recess 222 and slides forwards so that the drilling head 30 can grind a friction wheel 40, the friction wheel 40 will move. In the grinding process, if it is desired to adjust the protruding length of the drilling head 30, the hook rod adjusting button 245 can be rotated immediately.

What is claimed is:

1. A drilling-head-grinding positioning device comprising:

a clamper for clamping a drilling head having a rectangular sliding rod and a sleeve clamping seat installed at a front end of the sliding rod, a cylindrical clamping device received in the sleeve clamping seat and a nut screwed at a front end of the sleeve clamping seat; and an adjustable seat; and a top of the adjustable seat having a V shape sliding recess corresponding to the periphery of the sliding rod; a bottom of the sliding recess being formed with a receiving trench for receiving a threaded rod; one side of the sliding recess being formed with a communicating groove communicated to the receiving trench; a hook rod being slidably installed in the receiving trench; a front end of the hook rod being extended upwards with a plate corresponding to a front end of the sliding rod; a rear axial center of the hook rod being formed with a threaded hole; a press having one end fixed to the communicating groove by using a screw rod; another end of the press being retained above the hook rod to position the hook rod; a top of the press being lower than the plate; the hook rod adjusting button being a round button and being rotatably combined to the screw rod; and the screw rod being installed in the threaded hole at the rear end of the hook rod.

2. The drilling-head-grinding positioning device as claimed in claim 1, further comprising:

an adjustable seat having a base, a rotary seat which is rotatably combined to one side of the base, an assembly arm combined to the rotary seat, a hook rod adjusting set combined to the assembly arm and the rotary seat;

the base having a bottom plate; one side of the bottom plate being extended with a rotatable combining portion;

the rotary seat being a long block; one side thereof having a pivoted portion corresponding to the combining portion; thereby the rotary seat being rotatably combined to the base; a top of the rotary seat having the V shape sliding recess corresponding to the periphery of the sliding rod;

the assembly arm being an L shape arm; one end of the assembly arm being combined to a rear surface of the rotary seat and another end thereof being aligned to an opening of the sliding trench;

the hook rod adjusting set including a hook rod, a hook rod adjusting button and a threaded rod; the hook rod being a rectangular rod and being slidably installed in the receiving trench; a front end of the hook rod being extended upwards with a plate corresponding to a front end of the sliding rod; a rear axial center of the hook rod being formed with a threaded hole; a press having one end fixed to the communicating groove by using a screw rod; another end of the press being retained above the hook rod to position the hook rod; a top of the press being lower than the plate; the hook rod adjusting button being a round button and being rotatably combined to the screw rod; the screw rod being installed in the threaded hole at the rear end of the hook rod.

3. The drilling-head-grinding positioning device as claimed in claim 2, wherein a periphery of the hook rod adjusting button has scales, and the assembly arm is formed with a base scale corresponding to the scale of the adjusting button.

4. The drilling-head-grinding positioning device as claimed in claim 1, wherein four corners of the sliding rod are chamfered to form chamfered surfaces; the sliding rod is formed with an axial through hole; one front side of the sliding rod near the sleeve clamping seat is formed with an annular recess; the sliding rod has a threaded hole at the front end of the sliding rod; the threaded hole is communicated to the through hole;

the sleeve clamping seat is a round tube and a receiving tube extends from the sleeve clamping seat; the receiving tube is received in the through hole of the sliding rod; a periphery of the receiving tube has an annular recess; a screw screws into the threaded hole; an inner end of the screw resists against the annular recess so as to position the sleeve clamping seat to the sliding rod; an axial center of the sleeve clamping seat is formed with a tapered hole having a larger front end; a front end of the tapered hole is expanded as a threaded portion;

a periphery of the rear end of the cylindrical clamping device is a tapered surface and a front end thereof is formed with a clamping body, and a rear end thereof is corresponding to the tapered hole of the sleeve clamping seat; the drill head hole is formed at a front end of the clamping device; and a periphery of a rear end of the nut is formed with a threaded portion which is different to the threaded portion at the front end of the sleeve clamping seat; a front end of the nut has an embedding tapered hole corresponding to the shape of front end of the clamping device and engaging thereto.

* * * * *